US009422647B2

(12) United States Patent
Matthies et al.

(10) Patent No.: US 9,422,647 B2
(45) Date of Patent: Aug. 23, 2016

(54) METHOD AND APPARATUS FOR PRODUCING INTERTWINED KNOTS IN A MULTIFILAMENT THREAD

(75) Inventors: Claus Matthies, Ehndorf (DE); Mathias Stundl, Wedel (DE)

(73) Assignee: Oerlikon Textile GmbH & Co. KG, Remscheki (DE)

( * ) Notice: Subject to any disclaimer, the term of this patent is extended or adjusted under 35 U.S.C. 154(b) by 357 days.

(21) Appl. No.: 14/117,825

(22) PCT Filed: May 7, 2012

(86) PCT No.: PCT/EP2012/058325
§ 371 (c)(1),
(2), (4) Date: Nov. 14, 2013

(87) PCT Pub. No.: WO2012/156220
PCT Pub. Date: Nov. 22, 2012

(65) Prior Publication Data

US 2014/0068902 A1 Mar. 13, 2014

(30) Foreign Application Priority Data

May 19, 2011 (DE) ..... 10 2011 102 045

(51) Int. Cl.
*D02G 1/16* (2006.01)
*D02J 1/06* (2006.01)
*D02J 1/08* (2006.01)

(52) U.S. Cl.
CPC ..... *D02G 1/167* (2013.01); *D02G 1/162* (2013.01); *D02J 1/06* (2013.01); *D02J 1/08* (2013.01)

(58) Field of Classification Search
CPC ..... D02G 1/008; D02G 1/024; D02G 1/16; D02G 1/162; D02G 1/161; D02G 3/34; D02G 1/167; D02G 1/14; D02J 1/06; D02J 1/08
USPC ..... 28/271, 252; 57/908, 350
See application file for complete search history.

(56) References Cited

U.S. PATENT DOCUMENTS 3,110,151 A * 11/1963 Bunting, Jr. ..... D02J 1/08 28/258
3,394,440 A * 7/1968 Van Holten ..... D02J 1/08 28/272
3,937,252 A * 2/1976 Ishida ..... F15B 21/125 137/624.13

(Continued)

FOREIGN PATENT DOCUMENTS

DE 2062273 A1 7/1971
DE 4140469 A1 6/1993

(Continued)

*Primary Examiner* — Amy Vanatta
(74) *Attorney, Agent, or Firm* — BainwoodHuang

(57) ABSTRACT

A method and an apparatus produces intertwining knots in a multifilament thread. In this case, an air-stream pulse is directed through a nozzle opening transversely onto the thread. In order to produce a continuous succession of intertwining knots, the air-stream pulse is produced periodically with an interval between the air-stream pulses. In order to be able to produce an irregular thread structure, the interval between successive air-stream pulses is continuously changed. To this end, the apparatus has a nozzle ring carrying the nozzle opening, the nozzle ring being coupled to a drive. The drive of the nozzle ring is assigned a control device, by way of which a rotary speed of the nozzle ring is controllable for the purpose of changing an interval between the air-stream pulses.

20 Claims, 8 Drawing Sheets

(56) References Cited

U.S. PATENT DOCUMENTS

Figure 1:
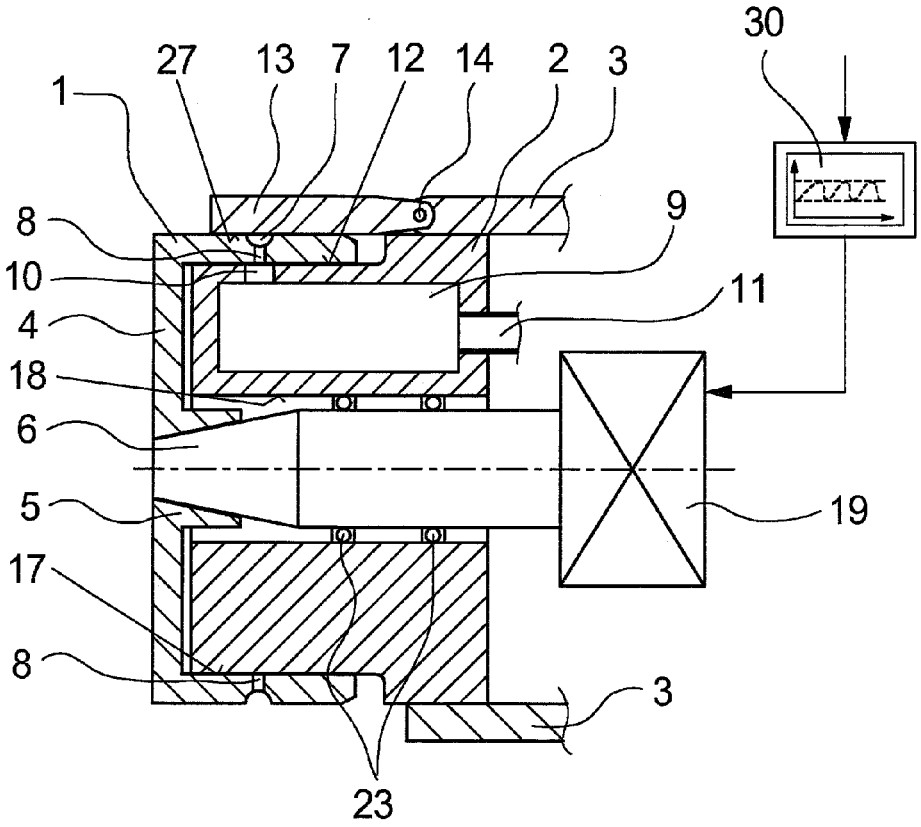

| | | | | | |
|---|---|---|---|---|---|
| 4,058,960 | A * | 11/1977 | Movshovich | D02G 3/286 | 137/624.13 |
| 5,134,840 | A | 8/1992 | Niederer et al. | | |
| 6,089,009 | A * | 7/2000 | Hand | D02G 1/161 | 57/282 |
| 2005/0011061 | A1 * | 1/2005 | Buchmuller | D02J 1/08 | 28/252 |
| 2012/0144633 | A1 * | 6/2012 | Kaulitzki | D02G 1/161 | 28/271 |
| 2013/0247341 | A1 * | 9/2013 | Stundl | D02J 1/06 | 28/254 |

FOREIGN PATENT DOCUMENTS

| | | | | |
|---|---|---|---|---|
| DE | 19501309 | A1 * | 8/1995 | D02J 1/08 |
| DE | 19703572 | A1 | 8/1998 | |
| EP | 0899366 | A2 | 3/1999 | |
| GB | 1593815 | A | 7/1981 | |

* cited by examiner

METHOD AND APPARATUS FOR PRODUCING INTERTWINED KNOTS IN A MULTIFILAMENT THREAD

The invention relates to a method for producing intertwined knots in a multifilament thread as disclosed herein, and an apparatus for producing intertwined knots in a multifilament thread as disclosed herein.

A generic method and a generic apparatus for producing intertwined knots in a multifilament thread are known from DE 41 40 469 A1.

In the manufacture of multifilament threads in particular in the melt spinning process, it is generally known that the cohesion of the individual filament strands in the thread is achieved by so-called intertwined knots. Intertwined knots of this type are produced by compressed air treatment of the thread. Depending on the type of thread and the process, the desired number of intertwined knots per unit length as well as the stability of the intertwined knots may be subject to different requirements. In particular in the manufacture of carpet yarns which are used for further processing, directly after a melt spinning process a high degree of knot stability as well as a relatively large number of intertwined knots per unit length of the thread are desirable.

In order to achieve in particular a relatively large number of intertwined knots at higher thread running speeds, in the generic method and the generic apparatus a rotating nozzle ring is used which has a thread guide groove at the periphery, into the groove base of which multiple nozzle holes open. The nozzle ring cooperates with a pressure chamber which has a chamber opening and which is periodically connected to the nozzle opening by rotation of the nozzle ring for generating an air flow pulse. The air flow pulse generated by the nozzle opening is directed transversely onto the thread which is guided in the guide groove of the nozzle ring, so that local turbulence of the filament strands occurs. By appropriate pressure adjustments in the pressure chamber, intensive air flow pulses are generated in such a way that they cause knotted intertwining of the filament strands within the thread.

Using the known method and the known apparatus, a sequence of uniformly produced intertwined knots may be produced in the thread. The nozzle openings symmetrically formed on the nozzle ring ensure a uniform thread structure which is specified by constant distances of the intertwined knots from one another. However, when the known method and the known apparatus are used in a melt spinning process for producing multicolor carpet yarns, it has been observed that undefined patterns and stripes are apparent in the further processing of the carpet. No significant improvement was obtained from a variant of the known method and the known apparatus in which the nozzle openings at the periphery of the nozzle ring are provided in different sizes in order to influence the knot formation of the intertwined knots.

The object of the invention, therefore, is to refine the generic method and the generic apparatus for producing intertwined knots in a multifilament thread in such a way that in the production of intertwined knots, a thread structure is obtained in which no undesirable visual patterns result during the further processing of the thread to form a flat thread product.

For the method according to the invention, this object is achieved in that the pause time between successive air flow pulses for producing intertwined knots is continuously changed.

The invention is based on the finding that the distance between the intertwined knots in the thread is largely determined by a pause time which forms the time period between two successive air flow pulses. Thus, a sequence of intertwined knots having irregular distances between the intertwined knots may be directly produced by changing the pause time. Visual patterns may advantageously be avoided by means of such irregular thread structures. The method according to the invention is therefore particularly suited for producing an irregular knot structure in a running thread.

The pause times between the air flow pulses may be changed using various method variants. In a first method variant, use is made of a rotational speed of a nozzle ring which bears the nozzle opening and periodically connects same to a pressure source during rotation. The pause time between the air flow pulses is proportional to the rotational speed of the nozzle ring. Brief pause times between the air flow pulses may be achieved at a high rotational speed of the nozzle ring. Conversely, slow rotational speeds of the nozzle ring result in corresponding long pause times.

In non-driven systems, the method variant is preferably used in which the pause time between the air flow pulses is changed by a geometric configuration of multiple nozzle openings formed on a rotating nozzle ring, the nozzle openings being connected one after another to a pressure source by rotating the nozzle ring. In this regard, use is made of a segment, provided between adjacent nozzle openings, at the periphery of the nozzle ring to be able to carry out a separate air flow pulse through each of the nozzle openings. The segment, i.e., the distance, between two adjacent nozzle openings has a proportional effect on the pause time between the air flow pulses. Thus, a long pause time is produced when there is a large distance between the nozzle openings. In contrast, short distances between adjacent nozzle openings at the nozzle ring result in correspondingly brief pause times. However, in this regard it is a requirement that the peripheral speed of the nozzle ring is constant. Thus, a pulse time of the pulse does not change, provided that all nozzle openings are the same size.

Another variant for influencing the pause time between the air flow pulses provides that the nozzle openings formed on a rotating nozzle ring have different geometric shapes. In addition to the pause time, the intensity of the air flow pulse may also advantageously be varied.

For the case that a system having a drive is used, the method variant is particularly advantageous in which the rotational speed of the nozzle ring is periodically changed between an upper limit speed and a lower limit speed. Such a change in the rotational speed of the nozzle ring, also referred to as "wobbling," offers the particular advantage that individual settings and thread structures for producing the intertwined knots are possible. It is thus also possible to change the pulse time of the pulse and the pause time between the pulses.

The change in the rotational speed of the nozzle ring is advantageously carried out according to a predefined function which causes, for example, a sinusoidal, stepped, or random change in the rotational speed.

To also be able to produce a sufficient variation of intertwined knots for high-speed processes, the method variant is preferably used in which the rotational speed is changed at a frequency in the range of 0.5 Hz to 20 Hz. Irregular thread structures may thus be produced in particular in the threads manufactured in melt spinning processes.

For an apparatus, the object of the invention is achieved in that a control device by means of which a rotational speed of the nozzle ring is controllable for the purpose of changing a pause time between the air flow pulses is associated with the drive of the nozzle ring, or that the nozzle ring has multiple nozzle openings arranged in a distribution at the periphery, and that the nozzle openings are distributed in an asymmetrical geometric configuration at the periphery of the nozzle ring in such a way that separation angles between respective adjacent nozzle openings are of unequal size.

Both alternative approaches provide the possibility of producing a sequence of intertwined knots having irregular distances between the intertwined knots. Nonuniform thread structures having different distances between the intertwined knots in the multifilament thread may thus be advantageously produced.

In principle, however, for a driven nozzle ring it is also possible to provide an asymmetrical geometric configuration of the nozzle openings at the periphery of the nozzle ring, so that the pause times between successive air flow pulses may be changed in a relatively large range.

The apparatus according to the invention may be further improved in that the nozzle ring has multiple nozzle openings arranged in a distribution at the periphery, and that the nozzle openings are formed in different geometric shapes. Due to the respective geometric shape of the nozzle opening, the intensity of the air flow pulse may advantageously be influenced so that the stability of the intertwined knots may be varied.

To ensure uniform thread quality in a manufacturing process, the apparatus variant is preferably used in which the control device has a control program by means of which the rotational speed of the nozzle ring is periodically changeable between a lower limit speed and an upper limit speed. The changes in the rotational speeds in relation to the thread running speeds may thus be kept in a noncritcal range.

To intensify the air treatment within the guide groove, it is provided that a movable cover is associated with the nozzle ring in the contact area between the guide groove and the thread, by means of which the guide groove is coverable. Radial escape of the air from the guide groove is thus avoided. The air is led through the cover in the peripheral direction of the guide groove.

To achieve more intensive air flow pulses, the apparatus according to the invention is preferably provided with a ring-shaped nozzle ring which has an inner sliding surface that cooperates with a cylindrical sealing surface of a stator into which the chamber opening directly opens. Thus, the nozzle opening may have a very short design between the inner sliding surface of the nozzle ring and the guide groove at the periphery of the nozzle ring. Compressed air flowing from the compressed air chamber passes through the nozzle opening and directly into the guide groove without major pressure losses.

Alternatively, however, it is also possible for the nozzle ring to have a disk-shaped design with a sliding surface on the end-face side, into which the nozzle holes open axially. The pressure chamber is provided at a stator situated to the side of the nozzle ring, the stator having a flat sealing surface opposite from the sliding surface of the nozzle ring on the end-face side, into which the chamber opening opens. The sliding surface of the nozzle ring cooperates with the sealing surface of the stator in order to introduce compressed air into the nozzle opening via the chamber opening. In this design of the nozzle ring, the nozzle openings each have a radial portion and an axial portion which preferably have different diameters. The radial portion of the nozzle opening, which opens directly into the groove base of the guide groove, is coordinated with the thread treatment, and usually has a smaller cross section than the axial portion of the nozzle opening, which opens at the sliding surface on the end-face side.

The method according to the invention and the apparatus according to the invention are particularly suited for producing stable, pronounced intertwined knots in large numbers and an irregular sequence in multifilament threads at thread speeds of higher than 3000 m/min.

Figure 2:
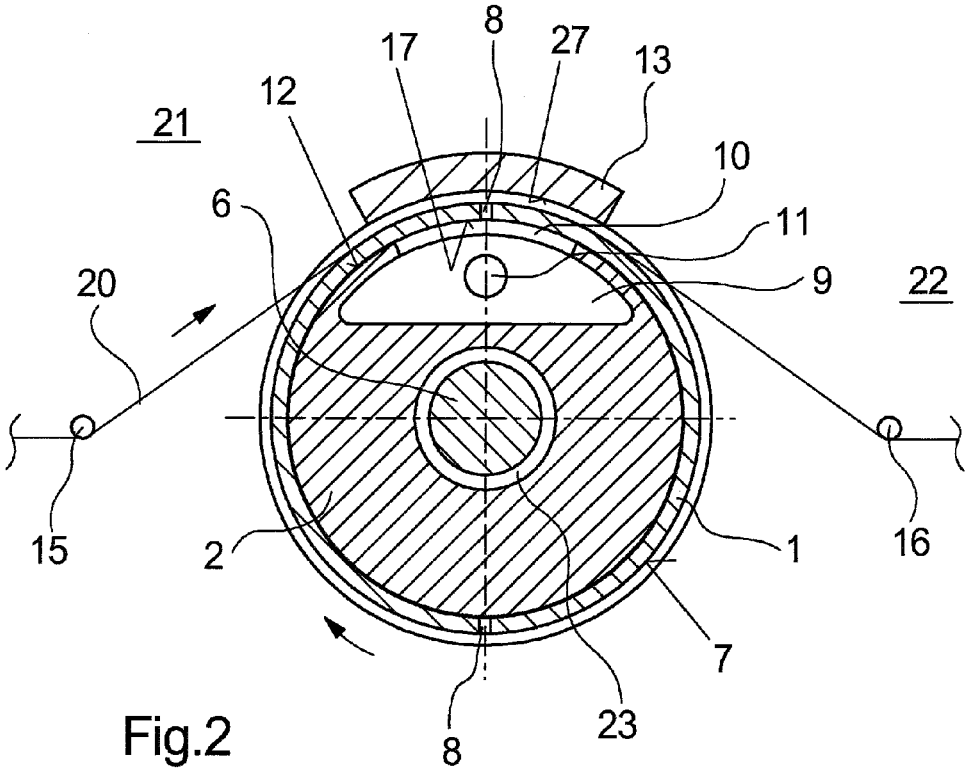
Figure 3:
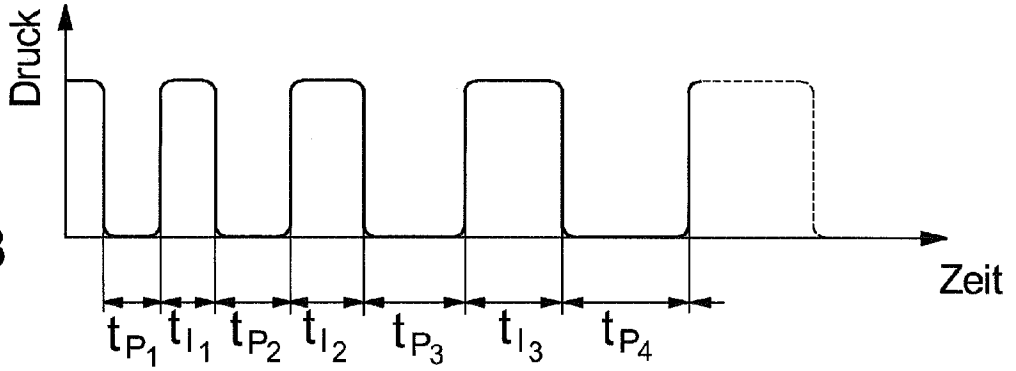
Figure 4:
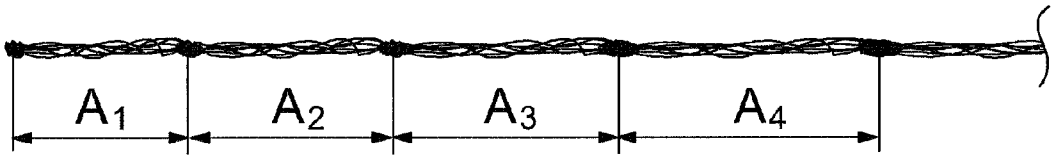
Figure 5:
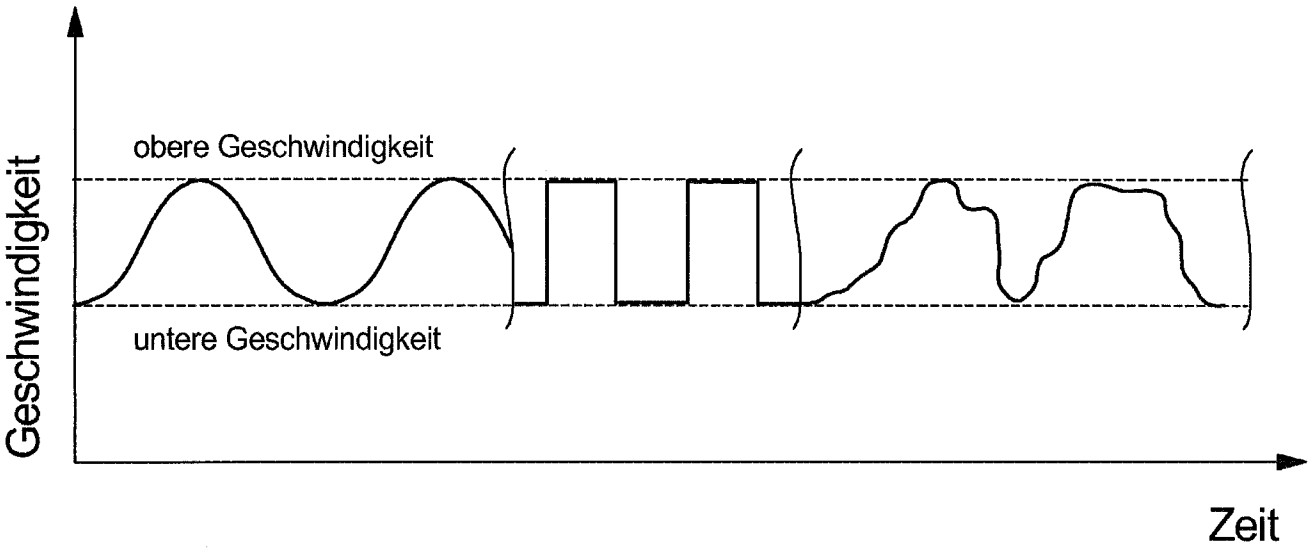
Figure 6:
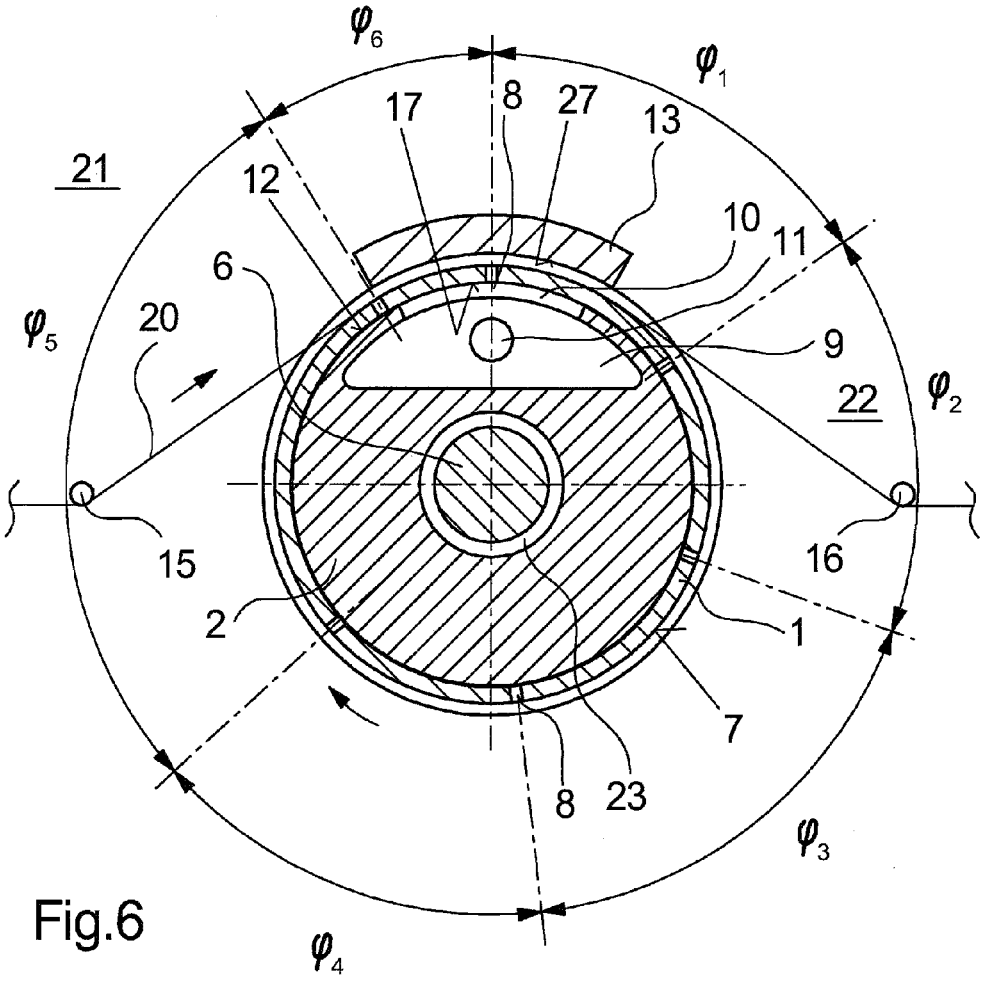
Figure 7:
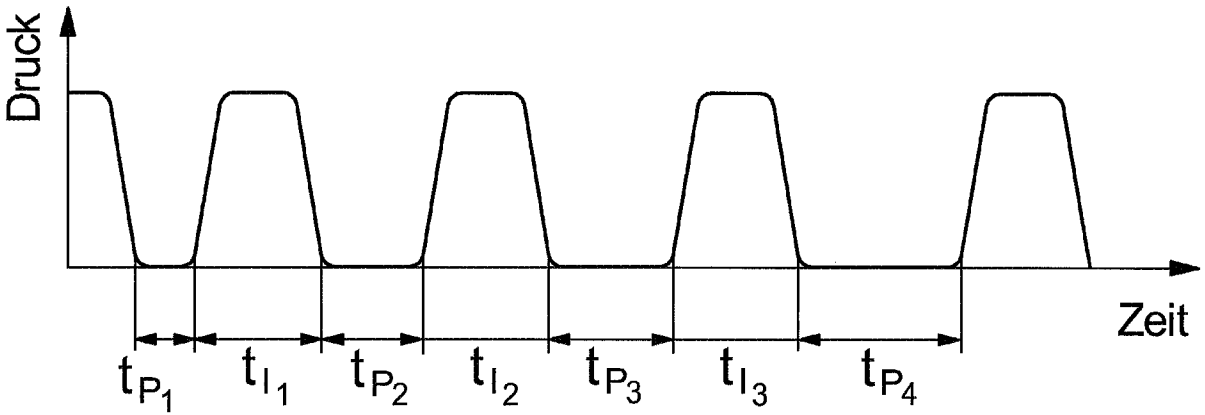
Figure 8:
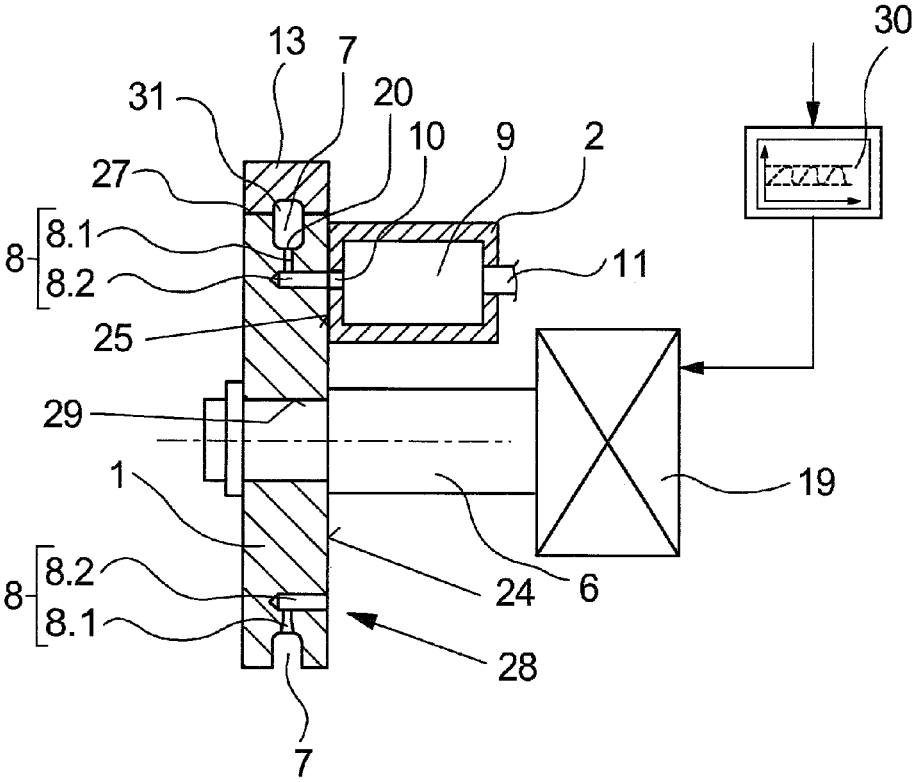
Figure 9:
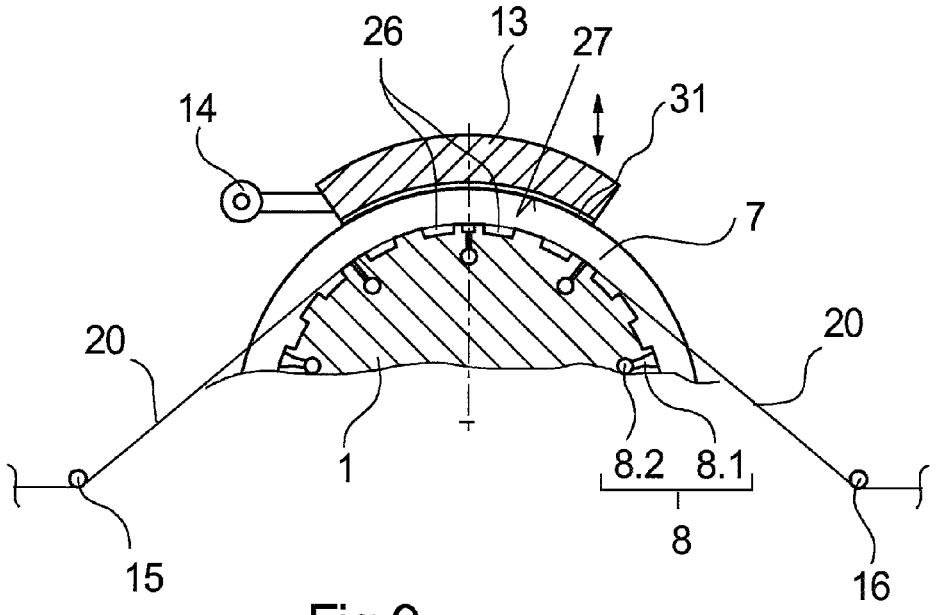

The method according to the invention is explained in greater detail below based on several exemplary embodiments of the apparatus according to the invention, with reference to the appended figures, which show the following:

FIG. 1 schematically shows a longitudinal section view of a first exemplary embodiment of the apparatus according to the invention;

FIG. 2 schematically shows a cross-sectional view of the exemplary embodiment from FIG. 1;

FIG. 3 schematically shows a variation over time of the air flow pulses generated by the nozzle openings;

FIG. 4 schematically shows a view of a multifilament thread having intertwined knots;

FIG. 5 schematically shows the curve of the rotational speed of the nozzle ring during wobbling;

FIG. 6 schematically shows a cross-sectional view of another exemplary embodiment of the apparatus according to the invention;

FIG. 7 schematically shows a variation over time of the air flow pulses generated by nozzle openings;

FIG. 8 schematically shows a longitudinal section view of another exemplary embodiment of the apparatus according to the invention; and FIG. 9 schematically shows a portion of a cross-sectional view of the exemplary embodiment from FIG. 7.

FIGS. 1 and 2 illustrate a first exemplary embodiment of the apparatus according to the invention in multiple views. FIG. 1 shows the exemplary embodiment in a longitudinal section view, and in FIG. 2 the exemplary embodiment is shown in a cross-sectional view. In this regard, no explicit reference is made to either one of the figures, so that the following description applies to both figures.

The exemplary embodiment of the apparatus according to the invention for producing intertwined knots in a multifilament thread has a rotating nozzle ring 1 which has a ring-shaped design and bears a circumferential guide groove 7 at the periphery. Multiple nozzle openings 8 which are provided in a uniform distribution over the periphery of the nozzle ring open into the groove base of the guide groove 7. In the present exemplary embodiment, two nozzle openings 8 are present in the nozzle ring 1. The nozzle openings 8 penetrate the nozzle ring 1 up to an inner sliding surface 17.

The nozzle ring 1 is connected to a drive shaft 6 via an end-face wall 4 provided on the end-face side and a hub 5 centrally situated at the end-face wall 4. For this purpose, the hub 5 is attached to a free end of the drive shaft 6.

The cylindrical inner sliding surface 17 of the nozzle ring 1 is guided in the manner of a shell on a guide section of a stator 2, which forms a cylindrical sealing surface 12 opposite from the sliding surface 17. At the periphery of the cylindrical sealing surface 12, at one position the stator 2 has a chamber opening 10 which is connected to a pressure chamber 9 provided inside the stator 2. The pressure chamber 9 is connected via a compressed air connection 11 to a compressed air source, not illustrated here. The chamber opening 10 in the cylindrical sealing surface 12 and the nozzle openings 8 at the inner sliding surface 17 of the nozzle ring are formed in a plane, so that the nozzle openings 8 are guided in the area of the chamber opening 10 by rotating the nozzle ring 1. For this purpose, the chamber opening 10 is designed as an elongated hole and extends in the radial direction over an extended guide area of the nozzle hole 8. The size of the chamber opening 10 thus determines an opening time of the nozzle opening 8 while the nozzle opening is generating an air flow pulse.

The stator 2 is mounted on a support 3, and has a middle bearing hole 18 which is formed concentrically with respect to the cylindrical sealing surface 12. The drive shaft is rotatably supported inside the bearing hole 18 by the bearings 23.

The drive shaft 6 is coupled at one end to a drive 19, by means of which the nozzle ring 1 is drivable at a predetermined rotational speed. The drive 19 could be formed, for example, by an electric motor situated to the side of the stator 2. A control device 30 is associated with the drive 19. In the present exemplary embodiment, the control device 30 has a control program in order to periodically vary the rotational speed of the nozzle ring 1 between a lower limit speed and an upper limit speed. The nozzle ring 1 may thus be driven by the drive 19 at a varying rotational speed.

As is apparent from the illustration in FIG. 1, a cover 13 which is mounted on the support 3 so as to be movable via a pivot axis 14 is associated with the nozzle ring 1 at the periphery.

As is apparent from the illustration in FIG. 2, the cover 13 extends in the radial direction at the periphery of the nozzle ring 1 over an area which on the inside includes the chamber opening 10 of the stator 2. On the side facing the nozzle ring 1, the cover 13 has an adapted cover surface 27 which completely covers the guide groove 7 and thus forms a treatment channel. In this area a thread 20 is guided in the guide groove 7 at the periphery of the nozzle ring 1. For this purpose, an inlet thread guide 15 is associated with the nozzle ring on an inlet side 21, and an outlet thread guide 16 is associated with the nozzle ring on an outlet side 22. The thread 20 may thus be guided between the inlet thread guide 15 and the outlet thread guide 16 with partial wrapping on the nozzle ring 1.

In the exemplary embodiment illustrated in FIGS. 1 and 2, compressed air is introduced into the pressure chamber 9 of the stator 2 for producing intertwined knots in the multifilament thread 20. The nozzle ring 1, which guides the thread 20 in the guide groove 7, generates periodic air flow pulses as soon as the nozzle openings 8 reach the area of the chamber opening 10. The air flow pulses result in local turbulences at the multifilament thread 20 so that a sequence of intertwined knots is formed on the thread. To be able to produce a sequence of intertwined knots on the thread having irregular distances between the intertwined knots, the rotational speed of the nozzle ring is changed. A pause time resulting between successive air flow pulses may thus be shortened by increasing the rotational speed of the nozzle ring. Conversely, shorter pause times for generating the successive air flow pulses may be achieved by increasing the rotational speed of the nozzle ring.

At this point, reference is also made to FIGS. 3 and 4 for explaining the processes. FIG. 3 illustrates a diagram of a pressure curve of the air flow pulses over time. The time axis is formed by the abscissa, and the pressure of the air flow pulse is plotted on the ordinate.

As is apparent from the illustration in FIG. 3, the air flow pulses generated by the nozzle openings 8 each have the same magnitude, and a pulse time which is a function of the rotational speed results. The pulse time is denoted by the lowercase letter $t_1$ on the time axis. A pause time results between the successive air flow pulses. The pause time is denoted by the lowercase letter $t_P$ in FIG. 3. The pause time is lengthened by a continuous slowing down of the rotational speed of the nozzle ring. Thus, the pause times $t_{P1}$, $t_{P2}$, and $t_{P3}$ have different lengths. The pause time $t_{P3}$ is larger than the pause time $t_{P2}$, which is larger than the pause time $t_{P1}$. Accordingly, the pulse times $t_{I1}$, $t_{I2}$, and $t_{I4}$ have different lengths.

The change in the pause times between the air flow pulses and the changes in the pulse times have a direct effect on the formation of the intertwined knots in the thread 20. FIG. 4 schematically shows a partial segment of the thread 20, with multiple intertwined knots having irregular spacing following one another. The distances between adjacent intertwined knots are denoted by the reference letters A in FIG. 4. Thus, the distances $A_1$, $A_2$, $A_3$, and $A_4$ are formed between the intertwined knots. Since the pause times between the air flow pulses have an effect which is proportional to the distance A between the intertwined knots, the same tendency is observed with increasing distances between the intertwined knots. Thus, the distance $A_3$ is larger than the distance $A_2$, which in turn is larger than the distance $A_1$.

The illustrations in FIG. 3 and in FIG. 4 thus pertain only to a brief phase in which the rotational speed of the nozzle ring 1 is slowed down. For an increase in the rotational speed of the nozzle ring 1, the reverse situation would correspondingly result. For this purpose, the rotational speed of the nozzle ring 1 is changed within certain limits according to a predefined control program.

Several exemplary embodiments of possible control programs are schematically plotted in a diagram in FIG. 5. The diagram represents a variation of the rotational speed over time. In this regard, speed is plotted on the ordinate and time is plotted on the abscissa. An upper limit speed and a lower limit speed are shown on the ordinate, which are to be maintained at the nozzle ring 1 during the air treatment of the thread so as not to jeopardize the particular manufacturing process for the thread. The rotational speed of the nozzle ring is periodically changed between the upper speed and the lower speed according to a predefined function. In this regard, three different functions which result in a periodic change in the rotational speed are indicated in FIG. 5. Thus, starting from the left half of the diagram, a sinusoidal curve of the rotational speed, a rectangular curve of the rotational speed, and a random curve of the rotational speed are illustrated in succession. Use may thus be made of sinusoidal or stepped or random changes in the rotational speed of the nozzle ring in order to influence the pause time between successive air flow pulses as well as the pulse time of the pulses.

The control program is stored in the control device 30, so that the drive may be operated with a corresponding superimposed wobbling of the rotational speed. The change in the rotational speed is in the range of 1% to 10% of the nominal value of the rotational speed. Thus, for a rotational speed of 2000 m/min, for example, the upper limit speed would be in the range of 2020 m/min and the lower limit speed would be 1800 to 1980 m/min. The periodic change in the rotational speed occurs at a frequency in the range of 0.5 Hz to 20 Hz, preferably in the range of 2 Hz to 10 Hz. Thus, at the customary thread speeds based on a thread length, repeating thread structures are displaced into noncritical areas.

FIG. 6 schematically shows another exemplary embodiment of the apparatus according to the invention in a cross-sectional view. The exemplary embodiment has a design which is identical to the above-mentioned exemplary embodiment according to FIGS. 1 and 2, so that further description at this point is dispensed with, and components having the same function are provided with identical reference numerals. Therefore, to avoid repetitions only the differences of the exemplary embodiment illustrated in FIG. 6 from the above-mentioned exemplary embodiment are mentioned here.

In the exemplary embodiment of the apparatus according to the invention illustrated in FIG. 6, multiple nozzle openings 8 are provided in the nozzle ring 1 in a distribution at the periphery of the nozzle ring 1 in an asymmetrical geometric configuration. The geometric configuration of the nozzle openings 8 is selected in such a way that the peripheral portions extending at the periphery of the nozzle ring 1 between two adjacent nozzle openings 8 have different lengths. The segment included between the nozzle openings 8 at the periphery of the nozzle ring 1 is proportional to a pause time between the air flow pulses generated by the nozzle openings 8. A sequence of intertwined knots having irregular distances between the intertwined knots is thus produced on a thread 20 during rotation of the nozzle ring 1. The separation angles which result between the nozzle openings 8 are depicted in FIG. 6 for illustrating the asymmetrical geometric configuration of the nozzle openings 8 on the nozzle ring 1. The separation angles are denoted by the Greek letters $\phi_1$ through $\phi_6$. The separation angles of the nozzle openings 8 following one another in the direction of rotation of the nozzle ring have different sizes in their sequence, whereby, for example, the separation angle $\phi_1$ could have the same size as the separation angle $\phi_4$.

The exemplary embodiment illustrated in FIG. 6 is also suited in particular for producing the necessary change in the pause times between the compressed air pulses and to produce irregular thread structures without wobbling of the rotational speed of the nozzle ring. In the exemplary embodiment illustrated in FIG. 6, it is thus also possible to operate with a drive or without a drive of the nozzle ring 1. However, it must be kept in mind that a minimum number of nozzle openings 8 is necessary at the periphery of the nozzle ring 1 in order to displace knot structures in the thread, which repeat due to multiple revolutions of the nozzle ring 1, into noncritical thread lengths.

FIG. 7 illustrates by way of example a pulse sequence which may be generated at constant rotational speed using the exemplary embodiment according to FIG. 6, for example. In the time curve illustrated in FIG. 7 of the air flow pulses generated by the nozzle openings, the abscissa represents the time axis and the ordinate represents the pressure axis. The pulse time of the compressed air pulses is denoted by the lowercase letter $t_I$, the successive pressure pulses each having constant pulse times. Thus, pulse times $t_{I1}$, $t_{I2}$, and $t_{I3}$ have the same length.

The pause times resulting between the compressed air pulses are denoted by the lowercase letter $t_P$. At a constant rotational speed of the nozzle ring, different pause times result due to the different division of the nozzle holes on the nozzle ring. In this regard, the pause time $t_{P1}$ could correspond to the angle $\phi_6$ in the exemplary embodiment according to FIG. 6. The subsequent pause times $t_{P2}$, $t_{P3}$, and $t_{P4}$ denote lengthened time intervals due to a larger angular division between the nozzle openings.

The exemplary embodiment of the pressure curve illustrated in FIG. 7 may also advantageously be linked to an additional change in the rotational speed. A high degree of flexibility is thus provided in order to obtain particular effects in the production of intertwined knots in a multifilament thread. In this regard, the rotational speed may be changed in a stepped manner, for example, from a maximum speed to a minimum speed.

FIGS. 8 and 9 illustrate another exemplary embodiment of the apparatus according to the invention. FIG. 8 schematically shows a longitudinal section view, and FIG. 9 schematically shows a partial view of a cross section. In this regard, no explicit reference is made to either one of the figures, so that the following description applies to both figures.

In the exemplary embodiment illustrated in FIGS. 8 and 9 of the apparatus according to the invention for producing intertwined knots in a multifilament thread, a nozzle ring 1 has a disk-shaped design. At the outer periphery the nozzle ring 1 bears a guide groove 7 which spans the nozzle ring 1 in the radial direction. Multiple nozzle openings 8 open into the groove base of the guide groove 7, the nozzle openings 8 formed in the nozzle ring 1 each having two nozzle opening sections 8.1 and 8.2. The nozzle opening section 8.1 is radially oriented, and opens into the groove base of the guide groove 7. The nozzle opening section 8.2 is axially oriented, and opens at an end face 28 of the nozzle ring 1. The nozzle opening section 8.2 is designed as a blind hole in such a way that the two nozzle opening sections 8.1 and 8.2 are connected to one another. The nozzle opening section 8.2 is preferably formed with a significantly larger diameter in order to supply compressed air to the nozzle opening section 8.1. The nozzle opening section 8.1 is used for generating the air flow pulse, which flows into the guide groove 7 for the thread treatment.

As is apparent in particular from FIG. 9, the nozzle opening section 8.1 provided in a distribution at the periphery of the nozzle ring 1 has different geometric shapes in order to influence the intensity of the air flow pulse. In this regard, the nozzle openings 8.1 may be circular, elliptical, kidney-shaped, or also polygonal in order to generate different air flow pulses. It has been found that more compact intertwined knots are produced with an elliptical nozzle opening compared to a circular nozzle opening.

As is apparent from the illustration in FIG. 8, the nozzle ring 1 is connected to a drive shaft 6 via a central mounting guide 29. The drive shaft 6 is coupled to a drive 19 which is controllable via a control device 30.

A sliding surface 24 into which the nozzle opening sections 8.2 open is formed at the end face 28 of the nozzle ring 1. A stationary stator 2 is mounted in an upper area of the nozzle ring 1, and with a flat sealing surface 25 is held against the sliding surface 24 of the nozzle ring 1 on the end-face side via a sealing gap. A pressure chamber 9 which is coupled via a compressed air connection 11 to a compressed air source, not illustrated here, is provided inside the stator 2. A chamber opening 10 is provided at the flat sealing surface 25 of the stator 2, and forms an outlet for the pressure chamber 9. The nozzle opening sections 8.2 thus reach the opening area of the chamber opening 10 one after the other during rotation of the nozzle ring 1, so that an air flow pulse may be introduced into the guide groove 7 of the nozzle ring 1.

As is apparent from the illustration in FIG. 9, a movable cover 13 is associated with the nozzle ring 1 above the stator 2, the cover being movable back and forth between a covered position and an open position (not illustrated) via a pivot axis 14. The cover 13 has a cover surface 27 which extends over a partial area of the guide groove 7 in the radial direction as well as in the axial direction, and which closes the guide groove to form a treatment channel. A corresponding relief groove 31 is formed inside the cover 13, opposite from the guide groove 7, and together with the guide groove 7 forms a turbulence chamber.

As is apparent from the illustration in FIG. 9, an inlet thread guide 15 and an outlet thread guide 16 for guiding a thread 20 are likewise associated with the nozzle ring 1. The thread 20 may thus be guided through the treatment channel formed with the cover 13 at the periphery of the guide groove 7.

The function for producing intertwined knots is identical in the exemplary embodiment illustrated in FIGS. 8 and 9 and in the exemplary embodiment according to FIGS. 1 and 2, so that no further explanation is provided here. In contrast to the above-mentioned exemplary embodiment, the knot formation of the intertwined knots is also influenced by the particular geometric shape of the nozzle opening 8.1. Thus, in addition to an irregular knot structure in the thread as a result of wobbling the rotational speed of the nozzle ring 1, it is also possible to influence the stability of the intertwined knots.

In addition, in the exemplary embodiment illustrated in FIG. 9 the groove base of the guide groove 7 is provided with multiple recesses 26 which are formed with uniform distribution between adjacent nozzle openings 8.1 at the periphery of the nozzle ring 1. This results in alternating contact areas and noncontact areas within the guide groove at which the thread 20 is guided. Additional turbulence effects may thus [be provided] which assist in the formation of the intertwined knots for the different geometric shapes of the nozzle openings.

The illustrated exemplary embodiments of the apparatus according to the invention are all suited for carrying out the method according to the invention. In principle, the method according to the invention may also be carried out by types of apparatuses in which the treatment channel has a stationary design and in which an air inlet is associated with the nozzle opening, the air inlet generating pulse-like compressed air flows and being introduced into the nozzle opening. Air inlets of this type may be implemented, for example, by rotating pressure chambers or compressed air valves.

LIST OF REFERENCE NUMERALS

1 Nozzle ring
2 Stator
3 Support
4 End-face wall
5 Hub
6 Drive shaft
7 Guide groove
8 Nozzle opening
8.1, 8.2 Nozzle opening section
9 Pressure chamber
10 Chamber opening
11 Compressed air connection
12 Cylindrical sealing surface
13 Cover
14 Pivot axis
15 Inlet thread guide
16 Outlet thread guide
17 Inner sliding surface
18 Bearing hole
19 Drive
20 Thread
21 Inlet side
22 Outlet side
23 Bearing
24 Sliding surface on the end-face side
25 Flat sealing surface
26 Recess
27 Cover surface
28 End face
29 Mounting guide
30 Control device
31 Relief groove

The invention claimed is:

1. Method for producing intertwined knots in a multifilament thread, in which the thread is guided with partial wrapping in a thread guide groove at a circumference of a nozzle ring and in which an air flow pulse is directed transversely onto the thread through a nozzle opening, and in which the air flow pulse is generated periodically with a pause time between the air flow pulses so that a continuous sequence of intertwined knots results in the running thread, wherein the pause time between successive air flow pulses for producing intertwined knots is continuously changed.

2. Method according to claim 1, wherein the pause time between the air flow pulses is changed by a rotational speed of a driven nozzle ring, the nozzle ring bearing the nozzle opening and periodically connecting the nozzle opening to a pressure source by rotation.

3. Method according to claim 1, wherein the pause time between the air flow pulses is changed by an asymmetrical geometric configuration of multiple nozzle openings formed on a rotating nozzle ring, the nozzle openings being connected one after another to a pressure source by rotating the nozzle ring.

4. Method according to claim 1, wherein (i) the pause time between the air flow pulses and (ii) the intensity of the air flow pulses are changed in that a rotating nozzle ring has nozzle openings which differ in shape from one another, the nozzle openings being connected one after another to a pressure source by rotating the nozzle ring.

5. Method according to claim 2, wherein the rotational speed of the nozzle ring is periodically changed between an upper limit speed and a lower limit speed.

6. Method according to claim 5, wherein the change in the rotational speed of the nozzle ring occurs in a sinusoidal, stepped, or random manner according to a predefined function.

7. Method according to claim 5, wherein the rotational speed of the nozzle ring is changed at a frequency in the range of 0.5 Hz to 20 Hz and an amplitude the range of ±1% to 10% of a nominal speed of the nozzle ring.

8. Method according to claim 1, wherein one of (i) the pause time between the air flow pulses and (ii) the intensity of the air flow pulses is changed in that a rotating nozzle ring has nozzle openings which differ in shape from one another, the nozzle openings being connected one after another to a pressure source by rotating the nozzle ring.

9. Apparatus for producing intertwined knots in a multifilament thread, having a rotating nozzle ring which has a circumferential guide groove for guiding the thread with partial wrapping and at least one nozzle opening which opens radially into the guide groove, having a stationary pressure chamber which is connectable to a compressed air source via a compressed air connection, having a chamber opening which is connectable to the nozzle opening of the nozzle ring, wherein the nozzle opening for producing an air flow pulse is connectable to the chamber opening by rotating the nozzle ring, and having a drive which is coupled to the nozzle ring, wherein a control device by means of which a rotational speed of the nozzle ring is controllable for the purpose of changing a pause time ($t_P$) between the air flow pulses is interacting with the drive of the nozzle ring.

10. Apparatus according to claim 9, wherein the nozzle ring has multiple nozzle openings arranged in a distribution at the circumference of the nozzle ring, and wherein the nozzle openings differ in shape from one another.

11. Apparatus according to claim 9, wherein the control device has a control program by means of which the rotational speed of the nozzle ring is periodically changeable between a lower limit speed and an upper limit speed.

12. Apparatus according to claim 9, wherein a movable cover is associated with the nozzle ring in a contact area between the guide groove and a thread, by means of which a treatment channel for accommodating the air flow pulses is formed.

13. Apparatus according to claim 9, wherein the nozzle ring has a ring-shaped design with an inner sliding surface into which the nozzle opening opens radially, wherein the pressure chamber is provided at a stator having a cylindrical sealing surface into which the chamber opening opens, and wherein the sliding surface of the nozzle ring cooperates with the sealing surface of the stator for transmitting compressed air.

14. Apparatus according to claim 9, wherein the nozzle ring has a disk-shaped design with a sliding surface on an end-face side of the nozzle ring, wherein the nozzle openings open axially into the end-face side of the nozzle ring, wherein the pressure chamber is provided at a stator which has a flat sealing surface into which the chamber opening opens, and wherein the sliding surface of the nozzle ring cooperates with the sealing surface of the stator for transmitting compressed air.

15. Apparatus for producing intertwined knots in a multifilament thread, having a rotating nozzle ring which has a circumferential guide groove for guiding the thread with partial wrapping and at least one nozzle opening which opens radially into the guide groove, having a stationary pressure chamber which is connectable to a compressed air source via a compressed air connection, and having a chamber opening which is connectable to the nozzle opening of the nozzle ring, wherein the nozzle opening for producing an air flow pulse is connectable to the chamber opening by rotating the nozzle ring, wherein the nozzle ring has multiple nozzle openings arranged in a distribution at the circumference of the nozzle ring, and wherein the nozzle openings are distributed in an asymmetrical geometric configuration at the circumference of the nozzle ring in such a way that separation angles ($\phi$) between respective adjacent nozzle openings are of unequal size.

16. Apparatus according to claim 15, wherein the nozzle ring has multiple nozzle openings arranged in a distribution at the circumference of the nozzle ring, and wherein the nozzle openings differ in shape from one another.

17. Apparatus according to claim 15, further comprising:

a control device has a control program by means of which the rotational speed of the nozzle ring is periodically changeable between a lower limit speed and an upper limit speed.

18. Apparatus according to claim 15, wherein a movable cover is associated with the nozzle ring in a contact area between the guide groove and a thread, by means of which a treatment channel for accommodating the air flow pulses is formed.

19. Apparatus according to claim 15, wherein the nozzle ring has a ring-shaped design with an inner sliding surface into which the nozzle opening opens radially, wherein the pressure chamber is provided at a stator having a cylindrical sealing surface into which the chamber opening opens, and wherein the sliding surface of the nozzle ring cooperates with the sealing surface of the stator for transmitting compressed air.

20. Apparatus according to claim 15, wherein the nozzle ring has a disk-shaped design with a sliding surface on an end-face side of the nozzle ring, wherein the nozzle openings open axially into the end-face side of the nozzle ring, wherein the pressure chamber is provided at a stator which has a flat sealing surface into which the chamber opening opens, and wherein the sliding surface of the nozzle ring cooperates with the sealing surface of the stator for transmitting compressed air.

* * * * *